US010274174B2

(12) United States Patent
Schneider

(10) Patent No.: US 10,274,174 B2
(45) Date of Patent: Apr. 30, 2019

(54) LAMP ASSEMBLY WITH IMPROVED CHARACTERISTICS

(71) Applicant: Alter Bee Corporation, Greenleaf, WI (US)

(72) Inventor: Andrew Michael Schneider, Greenleaf, WI (US)

(73) Assignee: Andrew Michael Schneider, Greenleaf, WI (US)

( * ) Notice: Subject to any disclaimer, the term of this patent is extended or adjusted under 35 U.S.C. 154(b) by 672 days.

(21) Appl. No.: 14/947,911

(22) Filed: Nov. 20, 2015

(65) Prior Publication Data

US 2016/0153643 A1 Jun. 2, 2016

Related U.S. Application Data

(60) Provisional application No. 62/083,105, filed on Nov. 21, 2014.

(51) Int. Cl.
*F21S 8/04* (2006.01)
*F21V 21/03* (2006.01)
*F21Y 115/10* (2016.01)

(52) U.S. Cl.
CPC ..... *F21V 21/03* (2013.01); *F21S 8/04* (2013.01); *F21Y 2115/10* (2016.08)

(58) Field of Classification Search
CPC ..... F21V 21/03; F21S 8/04
USPC ..... 362/311.02
See application file for complete search history.

(56) References Cited

U.S. PATENT DOCUMENTS 3,313,931 A 4/1967 Klugman
3,958,116 A * 5/1976 Jones ..... F21V 21/38 362/401
4,327,402 A * 4/1982 Aubrey ..... F21S 8/06 362/216
4,360,243 A * 11/1982 Johnson ..... H01R 33/94 439/662
4,564,257 A 1/1986 Smerz
(Continued)

FOREIGN PATENT DOCUMENTS

WO 2011107979 9/2011

OTHER PUBLICATIONS

5 Minute Light Upgrade, as viewed at http://www.prettyhandgirl.com/2012/10/5-minute-light-upgrade-convert-recessed-to-pendant.html on May 6, 2014 (14 pages).
(Continued)

*Primary Examiner* — Bryon T Gyllstrom
(74) *Attorney, Agent, or Firm* — Brannen Law Office, LLC

(57) ABSTRACT

A lamp assembly including members that allow the lamp fixture to be installed into a fixture base and be vertically adjusted relative thereto is provided. The lamp assembly has a casing, a riser and a control arm. The casing has a base section, a tapered section and a central bore. The riser has a first piece, a second piece and a third piece. The third piece of the riser is removably insertable into a socket of a fixed structure. The first and second pieces of the riser are rotatable relative to each other. The control arm has a first piece and a second piece. The first piece of the control arm causes the second piece of the riser to likewise rotate. The second piece of the control arm causes the casing to vertically raise or lower relative to the riser and hence relative to the fixed structure.

15 Claims, 17 Drawing Sheets

(56) References Cited

U.S. PATENT DOCUMENTS

| | | | | |
|---|---|---|---|---|
| 4,988,067 | A * | 1/1991 | Propp | F04D 25/088 248/343 |
| 6,616,112 | B1 * | 9/2003 | Tseng | F04D 25/088 248/323 |
| 7,249,871 | B2 | 7/2007 | Chen | |
| 7,470,041 | B2 | 12/2008 | Higgins et al. | |
| 8,299,903 | B2 | 10/2012 | Haase et al. | |
| 8,348,215 | B1 | 1/2013 | Smith | |
| 8,419,241 | B2 | 4/2013 | Jen et al. | |
| 8,454,204 | B1 | 6/2013 | Chang et al. | |
| 8,596,835 | B2 * | 12/2013 | Dai | F21S 8/00 362/101 |
| 2005/0265016 | A1 | 12/2005 | Rappaport | |
| 2011/0048793 | A1 * | 3/2011 | Ljungren | F21V 21/03 174/491 |
| 2012/0218748 | A1 | 8/2012 | Conrad | |
| 2012/0236580 | A1 * | 9/2012 | Cheng | F21V 29/00 362/387 |
| 2013/0250547 | A1 * | 9/2013 | Engstrom | F21V 21/03 362/95 |
| 2013/0265764 | A1 | 10/2013 | Holman et al. | |

OTHER PUBLICATIONS

Swivelier, Close Up Cover Plate Covers the Opening of a Recessed Fixture. 1 page.

Elightbulbs, as viewed at http://www.elightbulbs.com/Satco-77608-RECESD-LT-CNVRTR-SF77-608-Base-Modifier on May 3, 2014 (2 pages).

VFL10239-9 and VFL10239-10, as viewed at http://www.historichouseparts.com/sold_antique_flush_lights.html on May 3, 2014 (5 pages).

* cited by examiner

LAMP ASSEMBLY WITH IMPROVED CHARACTERISTICS

This patent application claims priority on and the benefit of provisional application 62/083,105 filed Nov. 21, 2014, the entire contents of which are hereby incorporated herein by reference.

BACKGROUND OF THE INVENTION

1. Field of the Invention

The present invention relates to a lamp assembly with improved characteristics including members that allow the lamp fixture to be installed into a standard fixture base and be vertically adjusted relative thereto.

2. Description of the Related Art

Many lighting products have been developed over the years aiming to accomplish a wide range of goals.

One example is a light sold at www.historic-houseparts.com under model number VFL10239. It describes how it screws into a light bulb socket on a bar bulb fixture and then makes it into a two light fixture.

Several patents and published applications also exist.

One example is U.S. Pat. No. 4,327,402 to Aubrey titled Light Fixture. It shows an adjustable-length light fixture having a standard fitting for connection to an incandescent light socket and providing for convenient conversion of a light fixture from incandescent use to use with another type of light source, such as fluorescent. The adjustable-length fixture includes an extensible member with two telescopically engaging portions and a positive action latch to inhibit further extension of the member once a desired length has been selected. The latch includes a resilient latch member on one telescopically engaging portion, and a number of rachet-like recesses on the other of the telescopically engaging portions, the recesses being so shaped as to inhibit further extension of the length of the fixture, but to facilitate shortening of the length as needed for installation purposes.

Another example is U.S. Pat. No. 7,249,891 to Chen titled Vertical Adjuster for Suspending Lamp. It shows a vertical adjuster for a suspending lamp comprises a cylinder at an upper end of the lamp; an inner upper side of the cylinder having a threaded section; a lead wire having one end connected to the lamp and being positioned at a bottom of the cylinder; another end of the lead wire being fixed to a retainer; an adjuster formed by a seat and a slidable annular block; a center of the seat having a hole; the seat being locked to an upper end of the cylinder; the slidable annular block having an axial hole; a lateral side of the slidable annular block having a radial screw hole communicated to the axial hole; a screw unit being located in the screw hole; a cross section of the slidable annular block being slightly larger than that of the hole and the slidable annular block being located below the seat.

A further example is U.S. Pat. No. 7,470,041 to Higgins et al. titled Light Fixture. It shows a light fixture removably attachable to a stationary socket includes a lamp socket mounted for receiving a lamp and a connector which is electrically engageable with such stationary socket. The connector is attached in spaced relationship to the lamp socket and is electrically connected thereto. The light fixture may include a housing having the lamp socket mounted therein with the connector attached to the housing in one of a rigid, hinged and swivel manner. The light fixture is advantageous for converting a unidirectional recessed light fixture into a multidirectional light fixture.

A still further example is shown in US Published Application Number 2005/0265016 to Rappaport titled Universal Trim for Recessed Lighting. It shows a universal trim piece for a recessed light includes a mounting side disposed toward a ceiling and having an aperture sized to conform with a dimension of an open side of a housing for a recessed light. A decorative side is disposed opposite the mounting side and a universal engagement member, disposed on the mounting side, removably engages a trim ring on the recessed light and secure the universal trim piece to the housing and proximate to the ceiling.

A still further example is shown in US Published Application Number 2013/0250547 to Engstrom et al. titled Lighting Conversion Apparatus. It shows a lighting conversion apparatus provided which converts a recessed light into a non-recessed light. A threaded electrical contact is designed to screw into the existing socket of a recessed light. The threaded electrical contact is connected to a socket extension, which is in turn connected to a socket extension base. A canopy is attached to the socket extension base, and fixtures extend from the canopy. The socket extension and socket extension base may telescope allow for shortening of the distance between the canopy and the threaded electrical contact. When installed, the canopy may therefore rest flush with the ceiling surrounding the recessed light hole.

While each of the above items may work well for their intended purposes, none solve the problems solved by the present invention and accordingly can be improved upon.

Some lamp fixtures require tools for installation, which is undesirable.

Some lamp fixtures are electrically inefficient which can lead to the unnecessary use of resources.

Some light bulbs are not recyclable, which contributes to unnecessary waste at the end of the bulbs useful life.

Some bulbs have an anticipated life span that is less than desirable.

Many existing light assemblies are not designed to readily accept LED lights.

Incandescent and florescent bulbs direct light into the ceiling wherein the light energy is wasted.

Many existing light fixtures are fragile and susceptible to breakage when dropped. If the bulb is made of glass, this could expose humans and animals to glass shards and other dangers.

It may be necessary to hire an electrician to wire and install (or change) current lighting fixtures.

Thus there exists a need for a lamp assembly that solves these and other problems.

SUMMARY OF THE INVENTION

A lamp assembly including members that allow the lamp fixture to be installed into a fixture base and be vertically adjusted relative thereto is provided. The lamp assembly has a casing, a riser and a control arm. The casing has a base section, a tapered section and a central bore. The riser has a first piece, a second piece and a third piece. The third piece of the riser is removably insertable into a socket of a fixed structure. The first and second pieces of the riser are rotatable relative to each other. The control arm has a first piece and a second piece. The first piece of the control arm causes the second piece of the riser to likewise rotate. The second piece of the control arm causes the casing to vertically raise or lower relative to the riser and hence relative to the fixed structure.

According to one advantage of the present invention, the lamp assembly comprises two-step adjustability. In a first step, the assembly is connected to a socket of a fixture base of a fixed structure. In a second step, the assembly is raised so that is comes into contact with a ceiling.

According to another advantage of the present invention, the adjustment mechanisms for both steps are located adjacent each other and are easily accessible to the user at the bottom of the lamp assembly.

According to a further advantage of the present invention, an adjustment mechanism for the vertical adjustment can be a decorative bulb accessible from outside the assembly, or can alternatively be a hole for receiving an Allen wrench or another type tool.

According to another advantage of the present invention, the lamp assembly is fully supported by the fixture base. In this regard, no tools are necessary and no modifications are required to be made to the fixture base or surrounding fixed structure in order to accommodate the installation of the present invention. Also, no special electrical knowledge is required and there is no need to hire an electrician to install the present invention.

According to another advantage of the present invention, the lamp assembly is adjustable in a vertical manner. Advantageously, this allows the lamp assembly to be moved into close contact with a ceiling without the need to twist a cover (which could lead to permanent damage or markings on the ceiling).

According to a further advantage of the present invention, the lamp assembly has a casing, a riser and a control arm that interact with each other to allow the lamp assembly to connect to a socket and to raise and lower in a vertical manner relative to the socket or other point of reference.

According to a still further advantage yet of the present invention, the lamp assembly can be installed into fixtures that are recessed or flush with the ceiling.

According to still further advantage yet of the present invention, the casing has vertically oriented slots to allow for clearance for electrical wires so that the assembly can be raised and lowered.

According to a still further advantage yet of the present invention, the riser has a sheath that protects electrical wires that pass through the riser.

According to a still further advantage yet of the present invention, the casing is shaped to provide an area for heat dissipation suitable for use with LED lights. This advantageously is a reason to expect extended life span of the LED lights. This is accomplished in one embodiment by having an opening in the raised section of the casing base and by having holes to allow for air flow and heat dissipation through the base section at the base section end of the outer ring of the base section.

According to a still further advantage yet of the present invention, several LED lights are arranged about the perimeter of the assembly in a circular pattern and can be directed downward and outward to minimize wasted light energy.

According to a further advantage yet of the present invention, the lamp assembly can replace a conventional low efficiency bulb with a high efficiency assembly. The present invention advantageously is a direct replacement for an incandescent or florescent bulb.

According to another advantage of the present invention, the light assembly is recyclable at the end of its useful life.

According to a still further advantage of the present invention, the fixture is configurable or modifiable so that it can be used with a variety of fixture bases (examples: Edison style, Bayonet style, etc.) without alteration of the bases.

According to another advantage of the present invention, the cover of the present invention can be made of a high strength plastic or other suitable material that is capable of withstanding impacts and drops without breaking or shattering.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
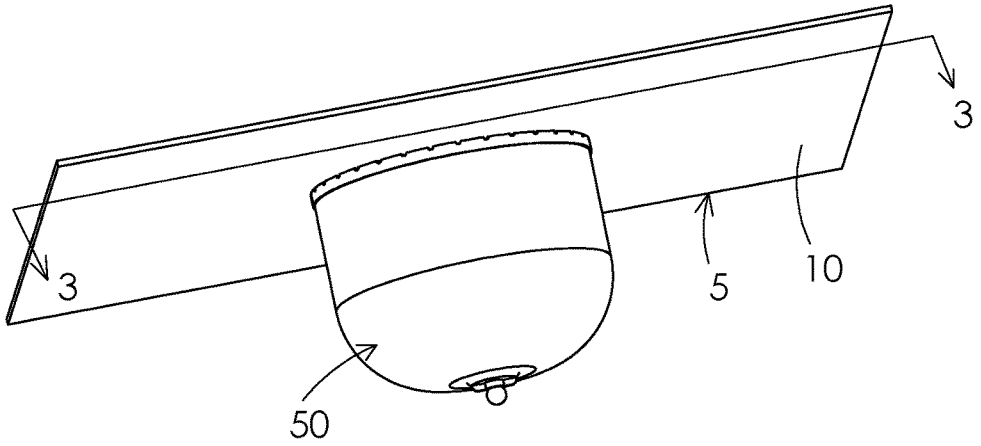
FIG. 1 is a perspective view of the present invention connected to a fixed structure.
Figure 2:
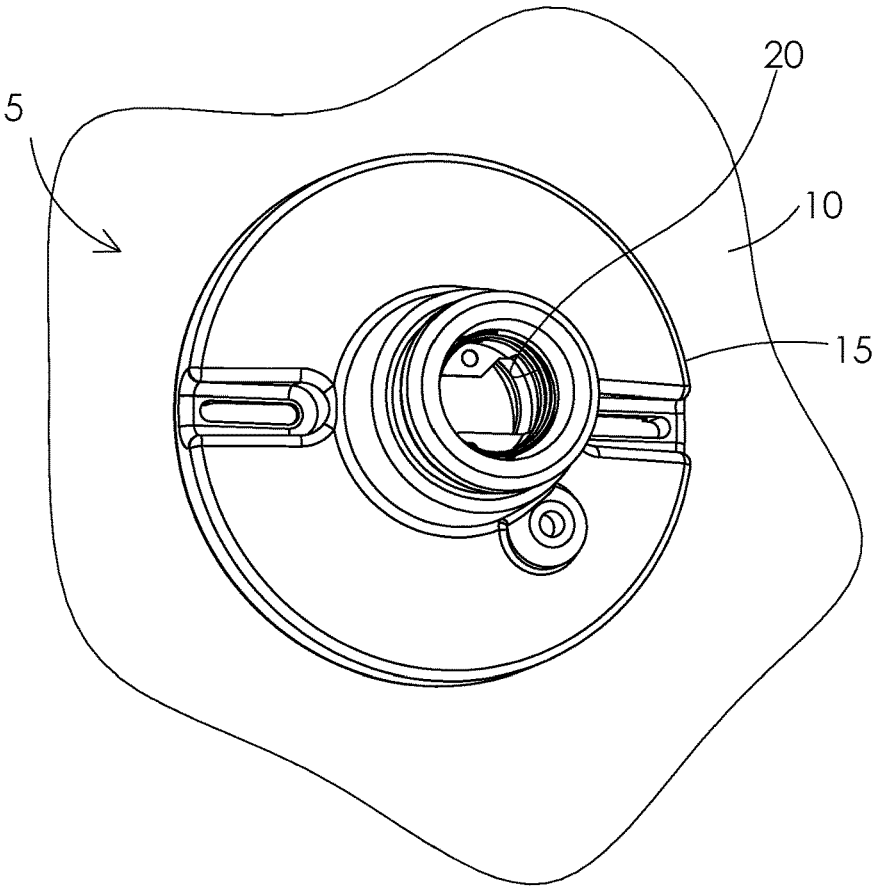
FIG. 2 is a perspective view of a fixed base having a socket.

The present invention can be connected to a fixed structure 5 as seen in FIGS. 1 and 2. Typically, the fixed structure 5 will has a ceiling 10 and a fixture base 15. The fixture base 15 will have a socket 20 that is internally threaded with threads. In the illustrated embodiment, the fixture base has a socket 20 that is intended to be located below the ceiling. However, it is understood that the present invention could alternatively be adapted for use with recessed sockets either through modification of the length of certain components or through the use of extensions without departing from the broad aspects of the present invention. The illustrated fixture base is for illustrative purposes only. The illustrated base is an Edison base. However, it could be a miniature Edison base, a bayonet style base or any other style base without departing from the broad aspects of the present invention.

Turning now to FIGS. 3-21, it is seen that a preferred embodiment of the present invention is illustrated. The lamp 50 has several components, including a casing 60, a riser 110, a control arm 180, a cover 240 and electronics 260. Each of these components is described below. It is appreciated that while several preferred dimensions are provided herein, that many alternative dimensions could be utilized without departing from the broad aspects of the present invention. For example, in one embodiment, the assembly can have an overall width of about 12 inches and an overall height of about 10 inches. Of course, these dimensions could be altered without departing from the broad aspects of the present invention.

Figure 8:
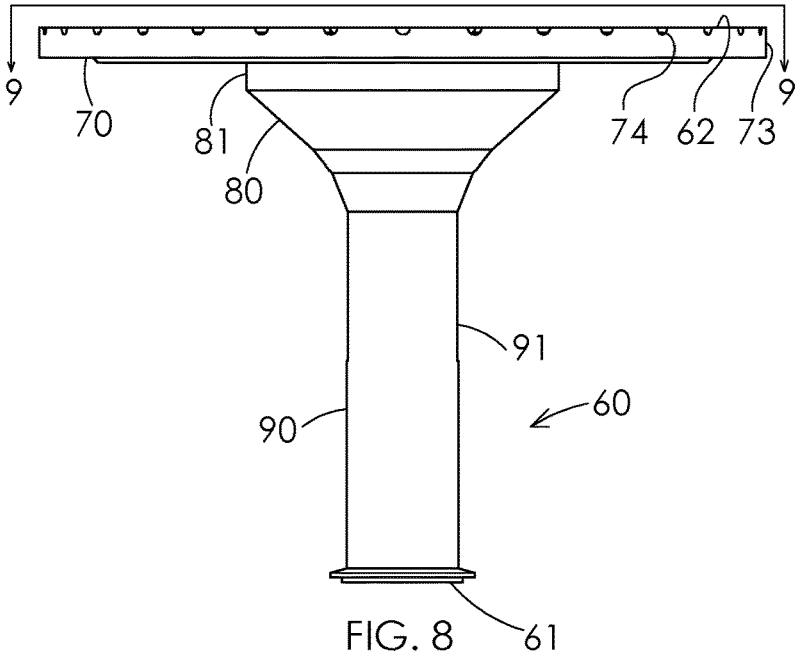
FIG. 8 is a side view of a casing of the present invention.
Figure 9:
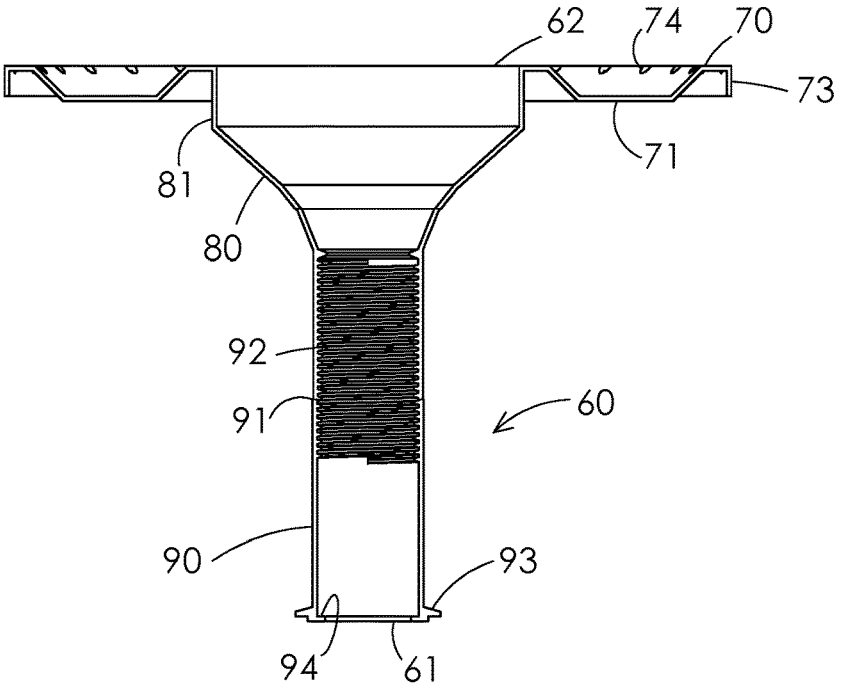
FIG. 9 is a cross-sectional view taken along line 9-9 in FIG. 8.
Figure 10:
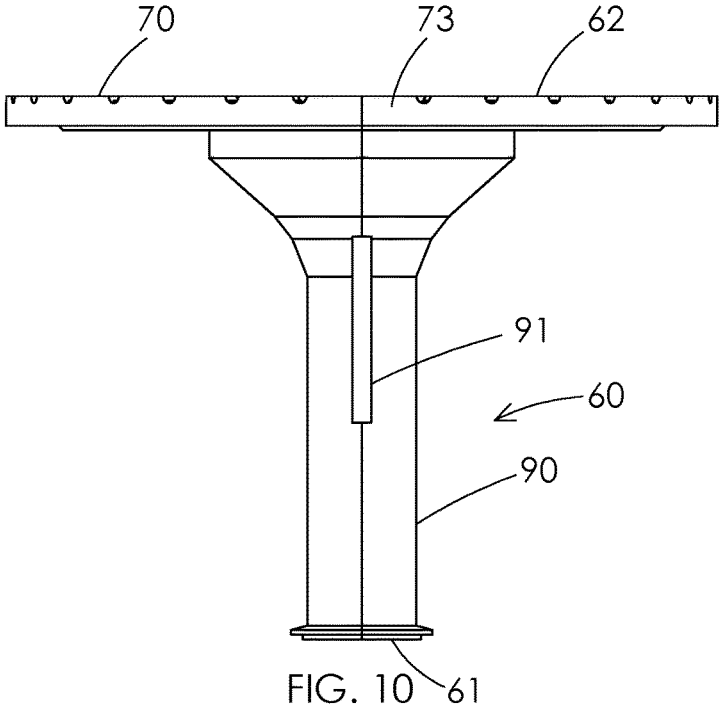
FIG. 10 is an end view of the casing shown in FIG. 8.
Figure 11:
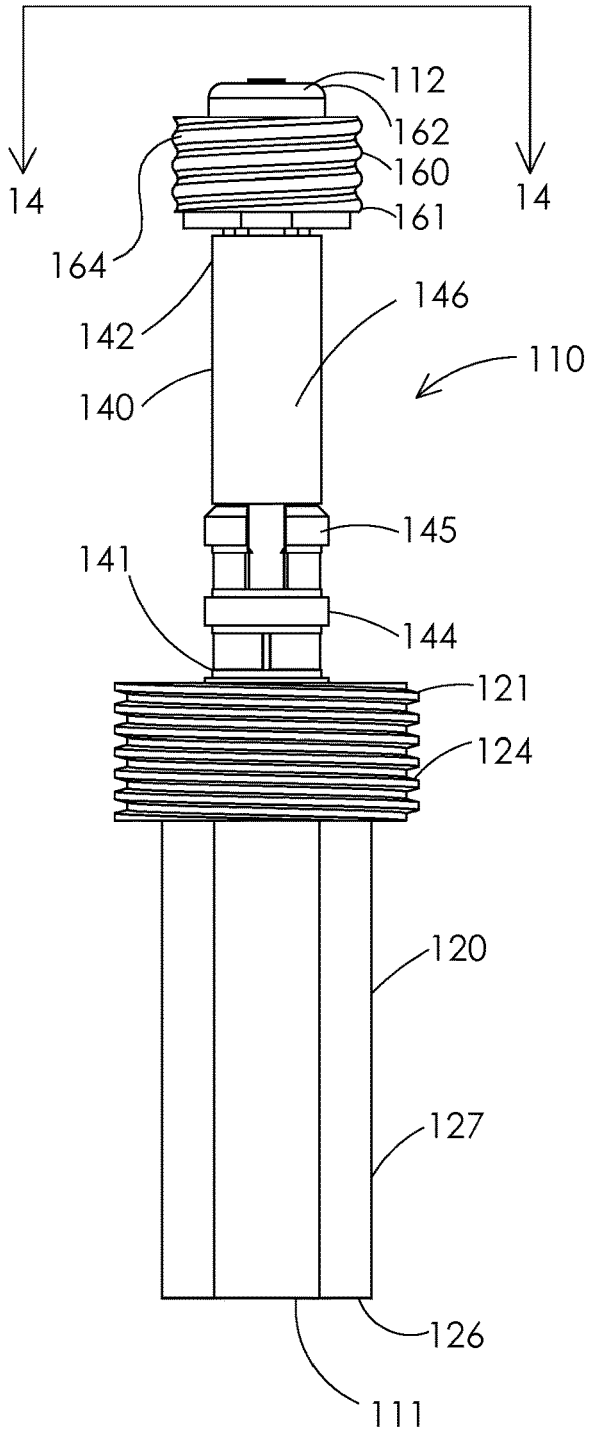
FIG. 11 is a side view of a riser of the present invention.
Figure 12:
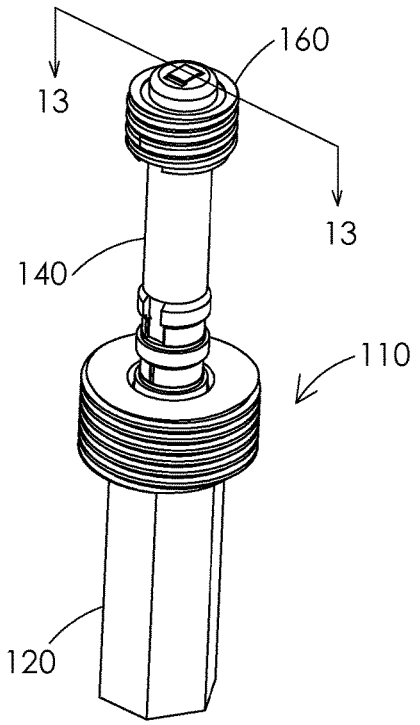
FIG. 12 is a perspective view of the riser shown in FIG. 11.
Figure 13:
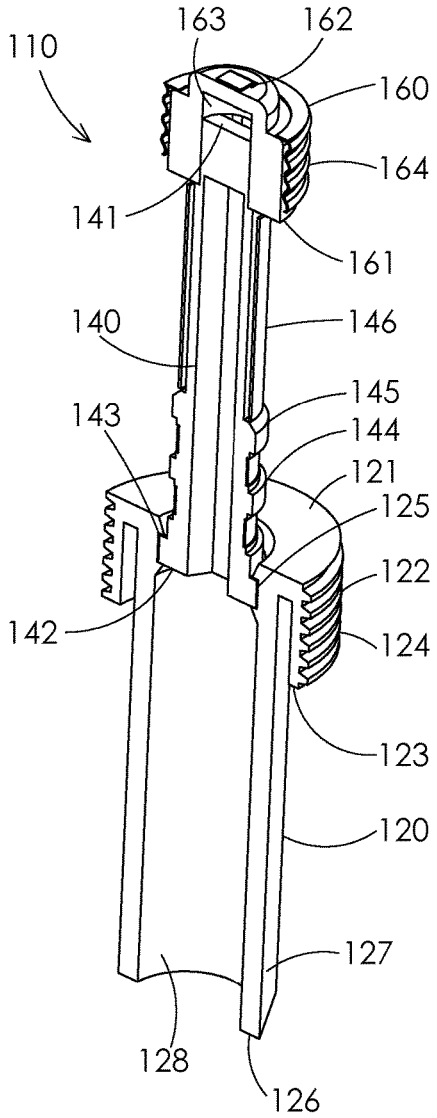
FIG. 13 is a cross-sectional view taken along line 13-13 in FIG. 12.
Figure 14:
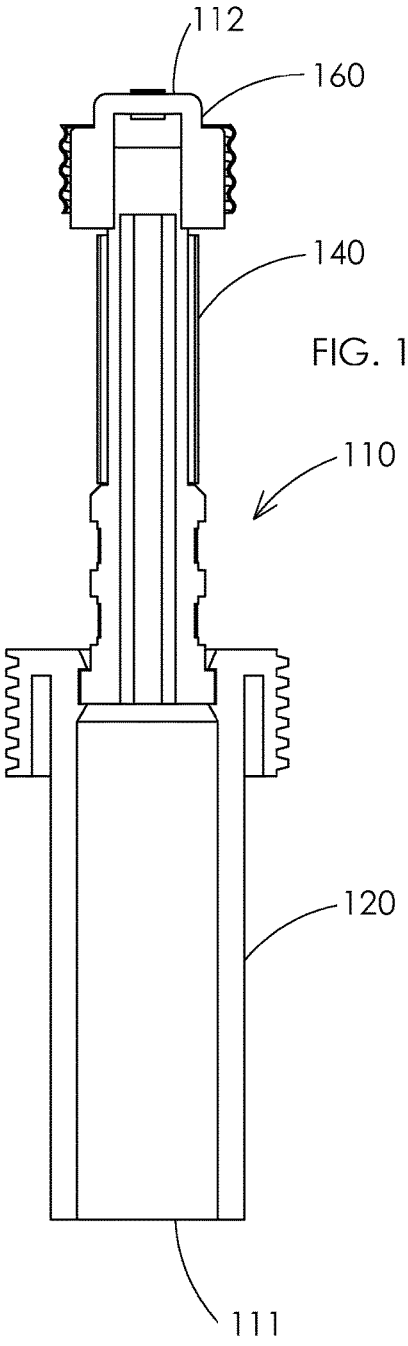
FIG. 14 is a cross-sectional view taken along line 14-14 in FIG. 11.

Looking now at FIGS. 8-10, it is seen that a casing 60 is provided. Casing 60 has two ends 61 and 62. The casing 60 has a base section 70 with a raised section 71 and an outer ring 73. The raised section 71 has a generally circular shape and preferably has a width of about 1.5 inches at the remote end and a height of about 0.5 inches. The inner and outer return portions can be tapered in a concave manner. A void is thus formed behind the raised section. A plurality of openings 72 are formed through the raised section and are open to the void. There are preferably four openings 72 which are preferably generally equally spaced and are arranged in a generally circular pattern to follow the shape of the raised section. The outer ring 73 preferably has a circular shape. The ring 73 has a wall with a height of preferably approximately 0.5 inches. Several holes 74, each preferably being in the shape of a semicircle, are spaced about the perimeter of the base to allow for air flow and heat dissipation between the ambient environment and the void formed below the raised section 71. The holes 74 are preferably equally spaced about the perimeter of the casing 60 and are located where the base of the ring 73 meets the remainder of the casing 60 and span into the void created by the raised section.

Figure 3:
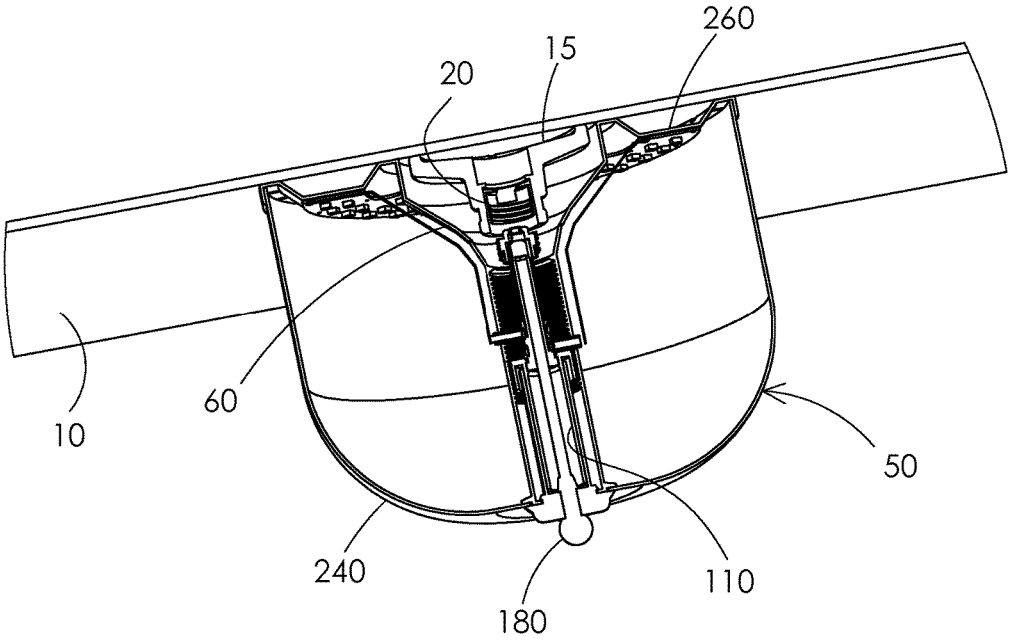
FIG. 3 is a cross-sectional view taken along line 3-3 in FIG. 1.
Figure 4:
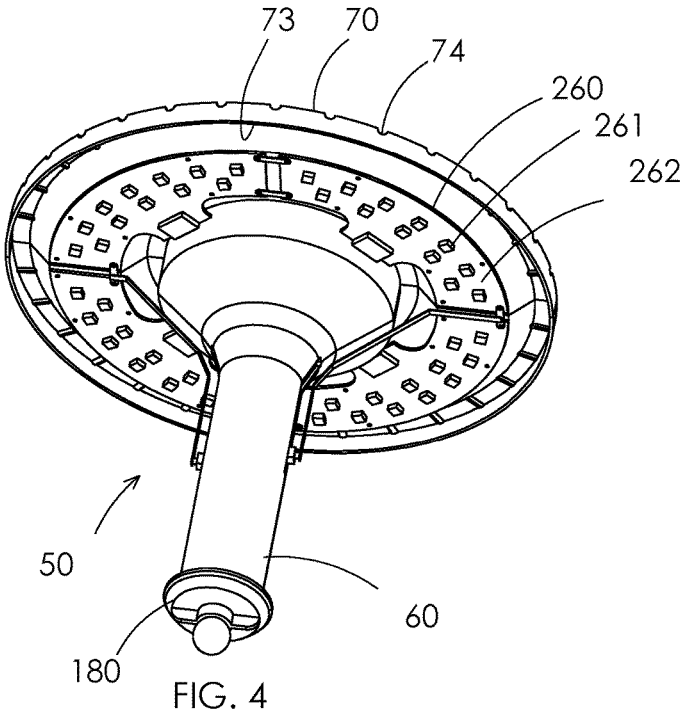
FIG. 4 is a perspective view of an embodiment of the present invention.
Figure 5:
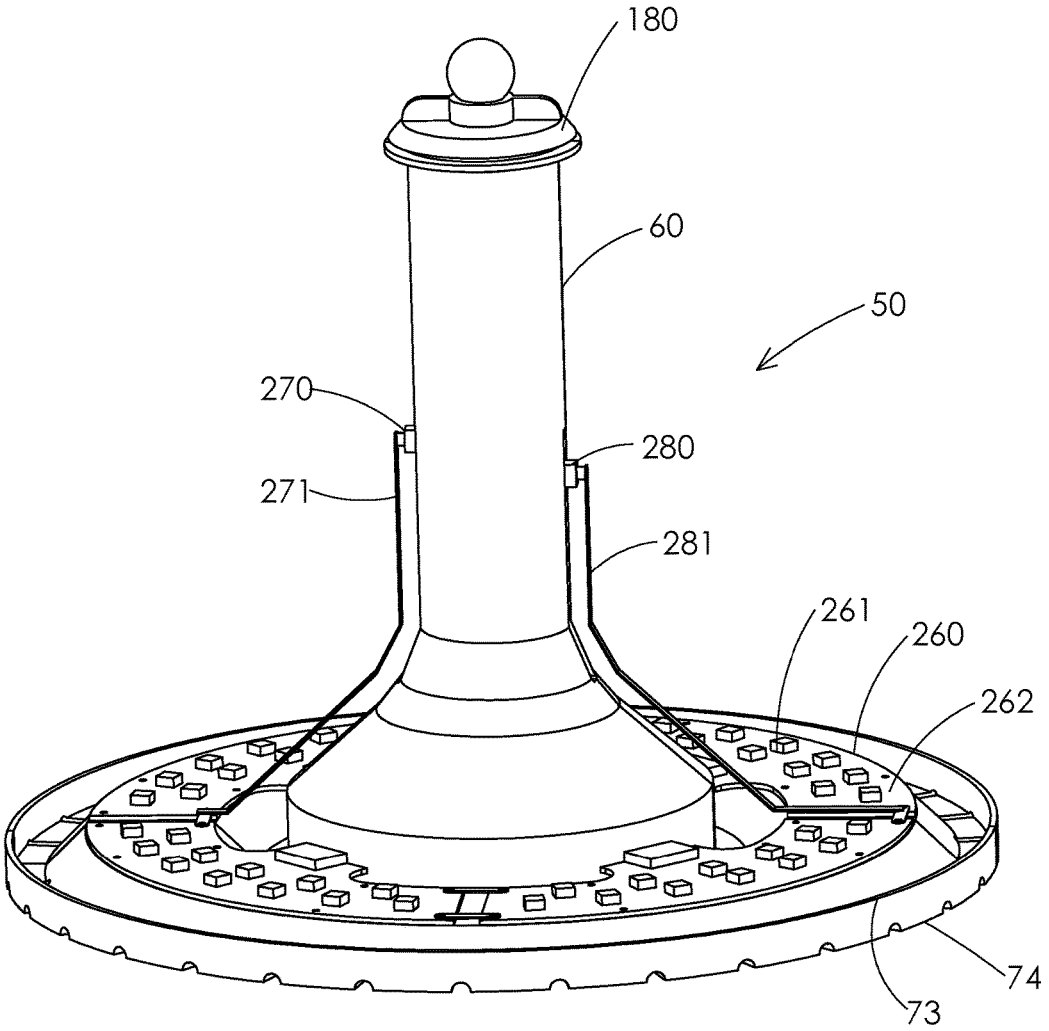
FIG. 5 is an alternative perspective view of an embodiment of the present invention.
Figure 6:
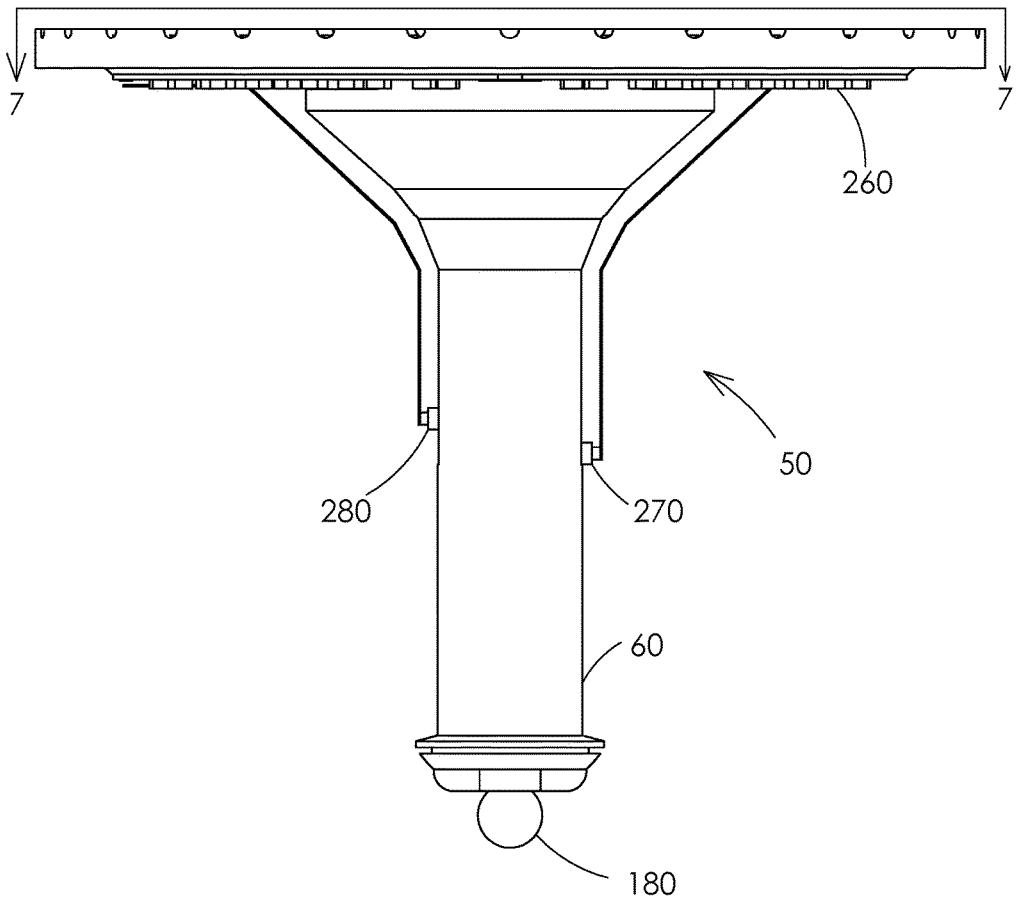
FIG. 6 is a side view of an embodiment of the present invention.

The casing 60 further has a tapered section 80. The tapered section 80 has a spacer section 81 at one end of the casing 60. The spacer section 81 allows the casing to have sufficient clearance relative to a fixture base 15, as seen in FIG. 3.

Figure 9A:
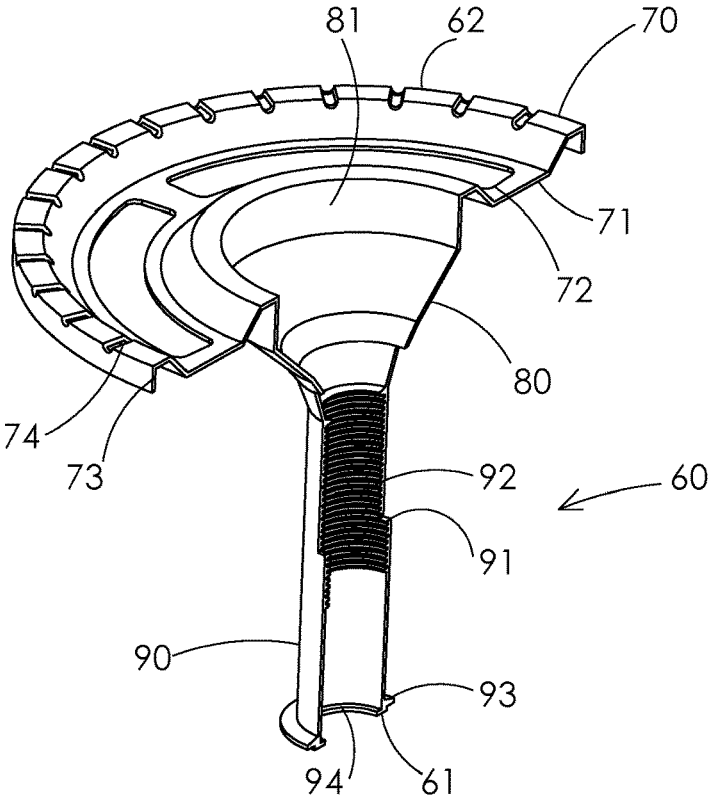
FIG. 9A is a cross-sectional close up perspective view of an end of a preferred casing of the present invention.

The casing 60 further has a central bore 90. The bore 90 has two slots 91 that are located through opposite portions of a central bore side wall. Preferably, each slot is spaced 180 degrees relative to each other and each preferably has a height of approximately 3 inches. The central bore 90 is internally threaded with threads 92 at one end of the bore 90. At the other end of the bore 90, there is an outer flange 93 extending outwardly and an inner lip 94 extending inwardly. The flange 93 and lip 94 are best seen in FIG. 9A.

The casing 60 can be made from two individual pieces that joined together to form the structure. In a preferred embodiment, the exposed side of the casing 60 can have a reflective surface in order to light rays downward and outward from the assembly of the present invention. One suitable surface is chrome. However, other reflective surfaces can be used without departing from the broad aspects of the present invention.

Turning now to FIGS. 11-14, it is seen that a riser 110 is provided. Riser 110 has two ends 111 and 112. The riser 110 has a first piece 120, a second piece 140 and a third piece 160.

The first piece 120 has a first end 121 with a spaced wall 122, a cavity 123, threads 124 and a retainer 125. The first piece 120 also has a second end 126 with a wall 127 and a bore 128. The wall 127 is preferably hexagonal in shape. The cavity 123 is between the spaced wall 122 and the wall 127. The threads 124 are preferably external on the spaced wall.

The second piece 140 has a first end 141 and a second end 142. A perimeter ring 143 is at the first end. Two electronics positioning bands 144 and 145 are also provided. The bands 144 and 145 are spaced about the outside of the second piece. A sheath 146 is further provided to cover the outside of a portion of the second piece between the electronics bands 144 and 145 and the second end 142 of the second piece. The sheath 146 covers two electric leads or lead wires 147 and 148 for protection.

The third piece 160 has a first end 161 and a second end 162. A bore 163 is at the first end wherein it can be press fit onto the second end 142 of the second piece. A threaded connector 164 is provided on the outside of the third piece for being removably screwed into a socket 20. Lead 147 extends to and is in electrical connection with the end of the third piece. Lead 148 is in electrical contact with the threaded connector.

It is appreciated that the riser third piece 160 is adapted for being threadably received within an Edison base. However, the third piece can be configured or modified for removably connection to a variety of fixture base styles, including but not limited to miniature Edison style bases, bayonet style bases and other style bases. This is accomplished in alternative embodiments by swapping the third piece wherein the lamp assembly is used with different sockets without altering the other components of the assembly.

Perimeter ring 143 is rotatably held within the retainer 125 of the first piece 120. In this regard, the first piece 120 and second piece 140 are rotatably secured to each other. Yet, rotation of the first piece 120 relative to the second piece 140 does not cause the overall length of the riser 110 to increase or decrease.

Figure 15:
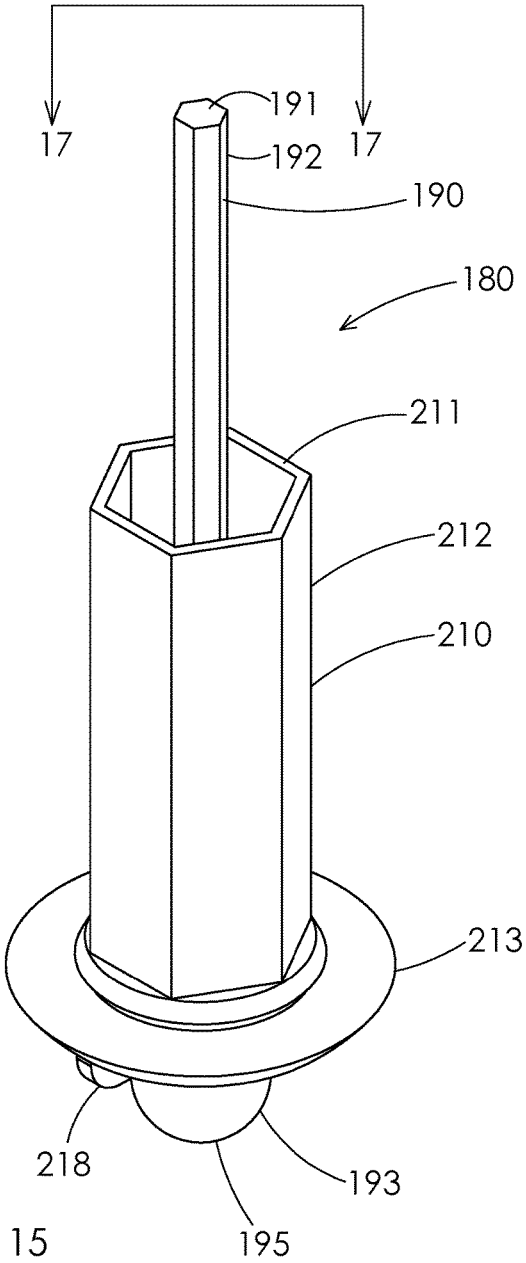
FIG. 15 is a perspective view of a control arm of the present invention.
Figure 16:
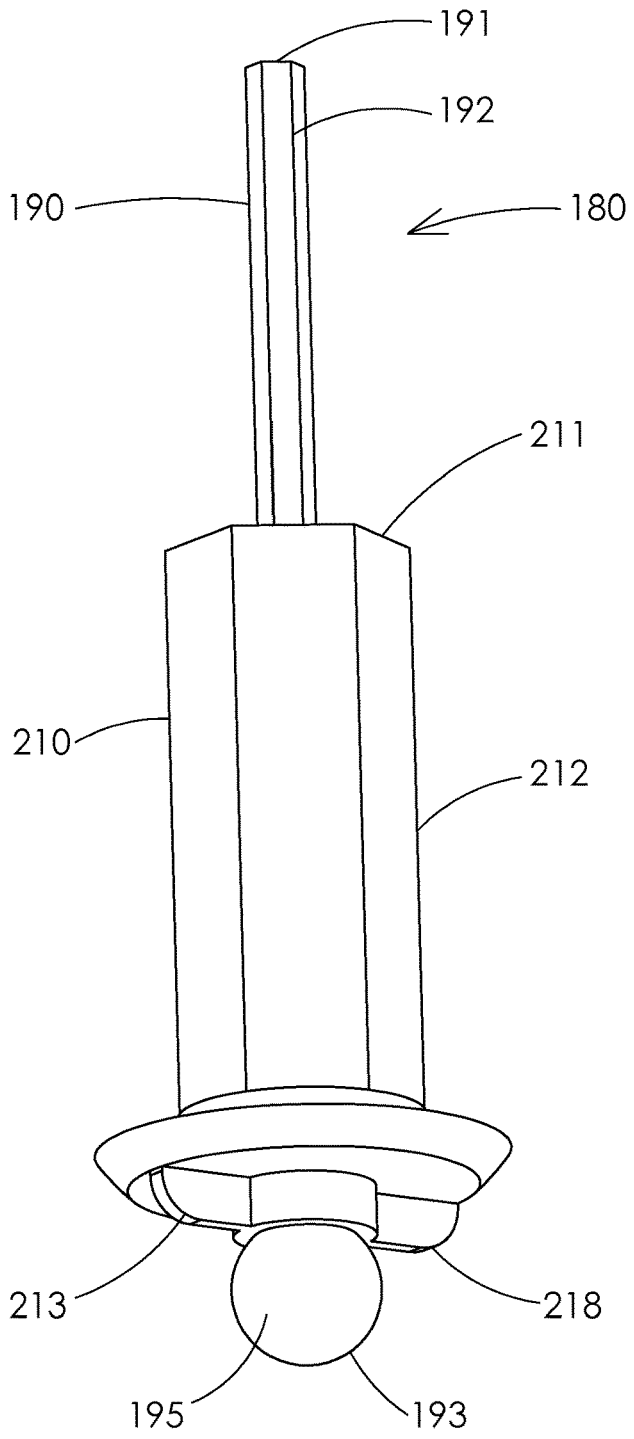
FIG. 16 is an alternative perspective view of the control arm shown in FIG. 15.
Figure 17:
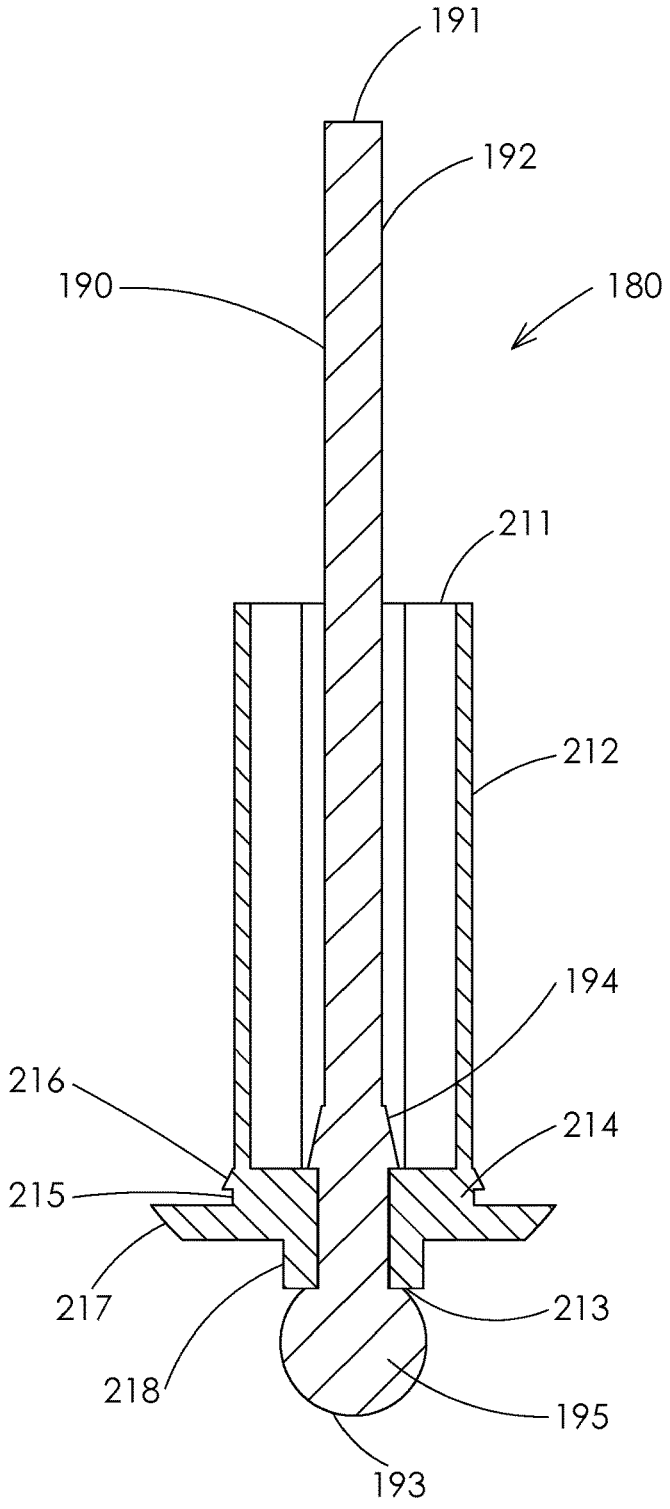
FIG. 17 is a cross-sectional view taken along line 17-17 in FIG. 15.

Turning now to FIGS. 15-17, it is seen that a control arm 180 is provided. The control arm 180 has a first piece 190 and a second piece 210.

The first piece 190 has an end 191 with an inner shaft 192. The first piece 190 has a second end 193 with a flare 194 and a bulb 195. The space between the flare 194 and bulb 195 defines a recess. It is understood that while a bulb 195 is shown, that other structures that are engageable by a user may be used without departing from the broad aspects of the present invention. In one alternative embodiment, an Allen wrench port can take the place of the bulb wherein the user can insert the Allen wrench into the port to engage the control arm.

The second piece 210 of the control arm 180 has a first end 211 with a shell 212. The shell 212 is preferably hexagonal in shape. The second piece 210 has a second end 213 with a shell base 214, a recess 215, a flange 216, a lip 217 and a grip 218. The shell base 214 is rotatable relative to the recess between the flare 194 and bulb 195 of the first piece, although the overall length of the control arm 180 is not affected by this rotation of pieces. The recess 215 is between the flange 216 and a lip 217. The grip 218 can be formed of one or two (or more) wings or other structures that allow the user to engage the second piece 210 in a rotatable manner.

Figure 18:
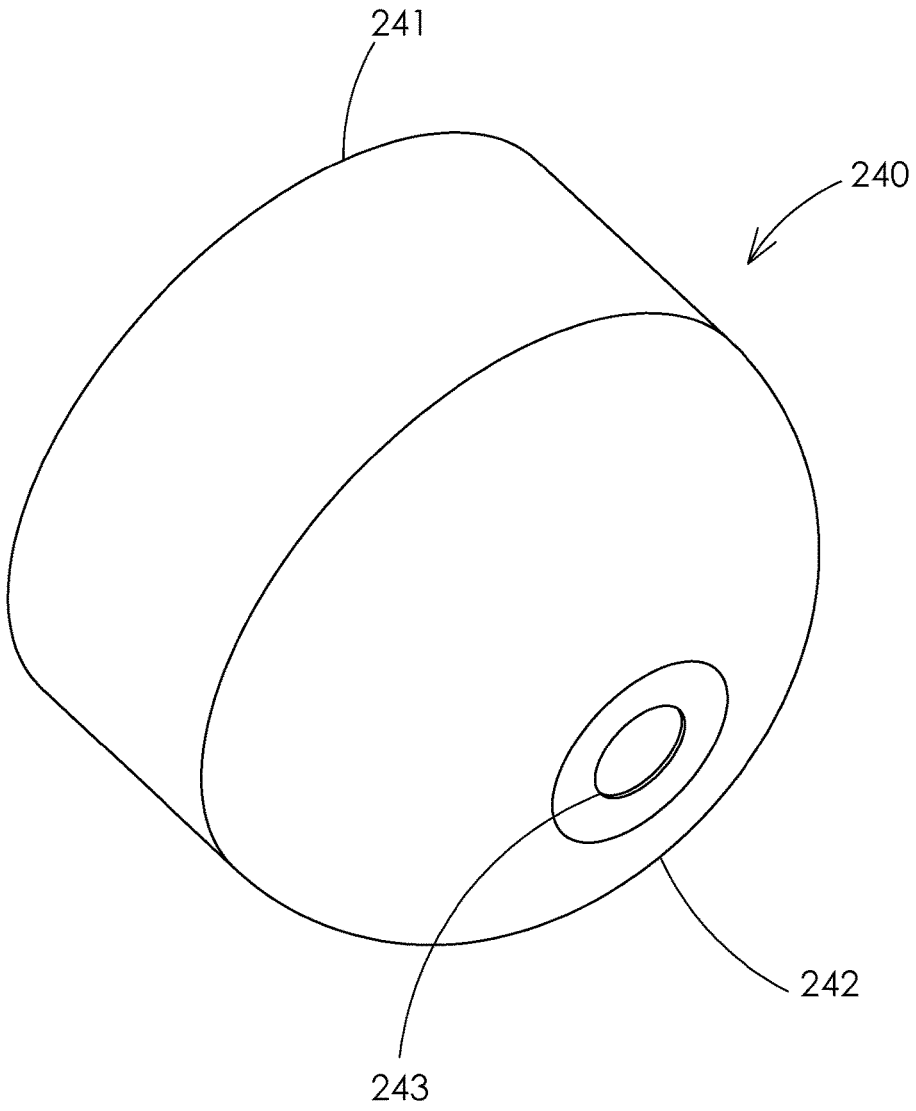
FIG. 18 is a perspective view of a preferred embodiment of a cover of the present invention.

Turning now to FIG. 18, it is seen that a cover 240 is provided. The cover 240 has a first end 241 and a second end 242. The first end 241 is an open end. The second end 242 has a central hole 243. The cover 240 is generally dome shaped. However, it is understood that the cover could have alternative shapes without departing from the broad aspects of the present invention. The cover is preferably transparent or translucent, depending on the user's preference. It is also appreciated that the cover is preferably made of an impact resistant material such as plastic. However, it can be made of other materials without departing from the broad aspects of the present invention.

Figure 19:
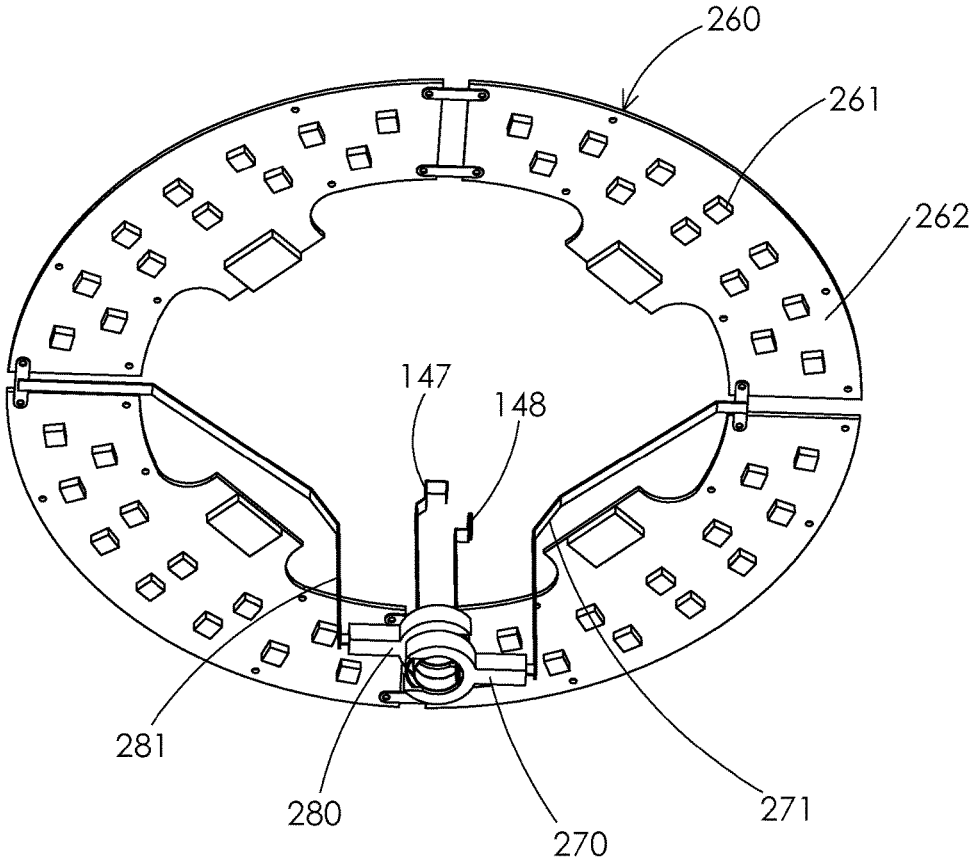
FIG. 19 is a perspective view showing electronics of the present invention.
Figure 20:
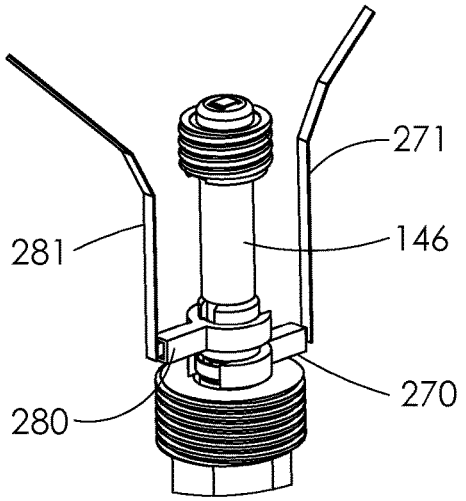
FIG. 20 is a perspective view of the riser showing a sheath concealing wires.
Figure 21:
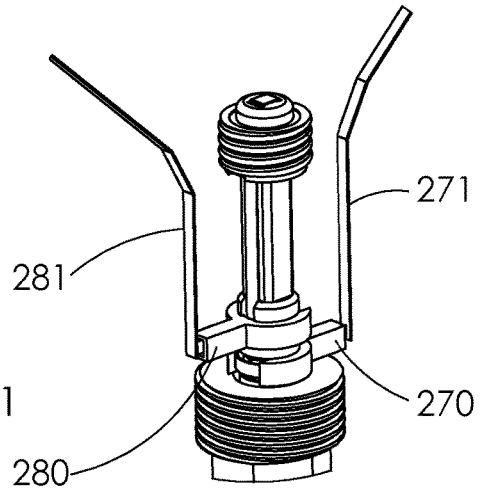
FIG. 21 is similar to FIG. 20 but shows the sheath removed.

Looking now at FIGS. 19-21, it is seen that electronics 260 are provided. The electronics 260 include LED lights 261, a wire collar 270 for wire 271 and a wire collar 280 for wire 281. The LED lights are preferably mounted on boards or plates. The LED lights 261 are preferably mounted on boards 262. There are preferably four boards 262 wherein each board is centered over a corresponding opening 72 through the raised section of the casing 60. In this regard, heat can be dissipated behind the raised section and released to the ambient environment through holes 74.

The collars 270 and 280 connect to the second piece 140 of the riser 110 adjacent electronics positioning bands 144 and 145. In this regard, collar 280 is attached between the positioning bands 144 and 145. Collar 270 is sandwiched between band 145 and the base. Hence, the positioning bands maintain the vertical position of the collars relative to the structure.

The interaction of the several structures and components of the present invention can be seen in FIGS. 4-8.

The first piece 190 of the control arm 180 is preferably polygonal (preferred hexagonal) in shape and is received within a like-shaped hole through the second piece 140 of the riser 110. In this regard, the second piece 140 of the riser 110 (and hence the third piece 160) rotates both clockwise and counter-clockwise as the first piece 190 of the control arm 180 is rotated via bulb 195.

In order to install the assembly 50 into a socket 20, the user first engages the engager bulb 195 of the control arm 180. Twisting of the bulb causes the second piece 140 of the riser (and hence the riser third piece 160) to likewise twist as described above. The third piece 160 is then threadably received within the socket 20 in a vertical manner to fully support the lamp assembly 50.

The second piece 210 of the control arm is preferably polygonal (preferred hexagonal) in shape and mates with like shaped first piece 120 of the riser. In this regard, the first piece 120 of the riser 110 rotates both clockwise and counter-clockwise as the second piece 210 of the control arm 180 is rotated via the grip 218. Threads 124 of the riser are in engaging alignment with the threads 92 of the central bore 90 of the casing. The riser is accordingly extended further from or retracted further into the casing by rotating the first piece of the riser into or out of the central bore of the casing.

Figure 7:
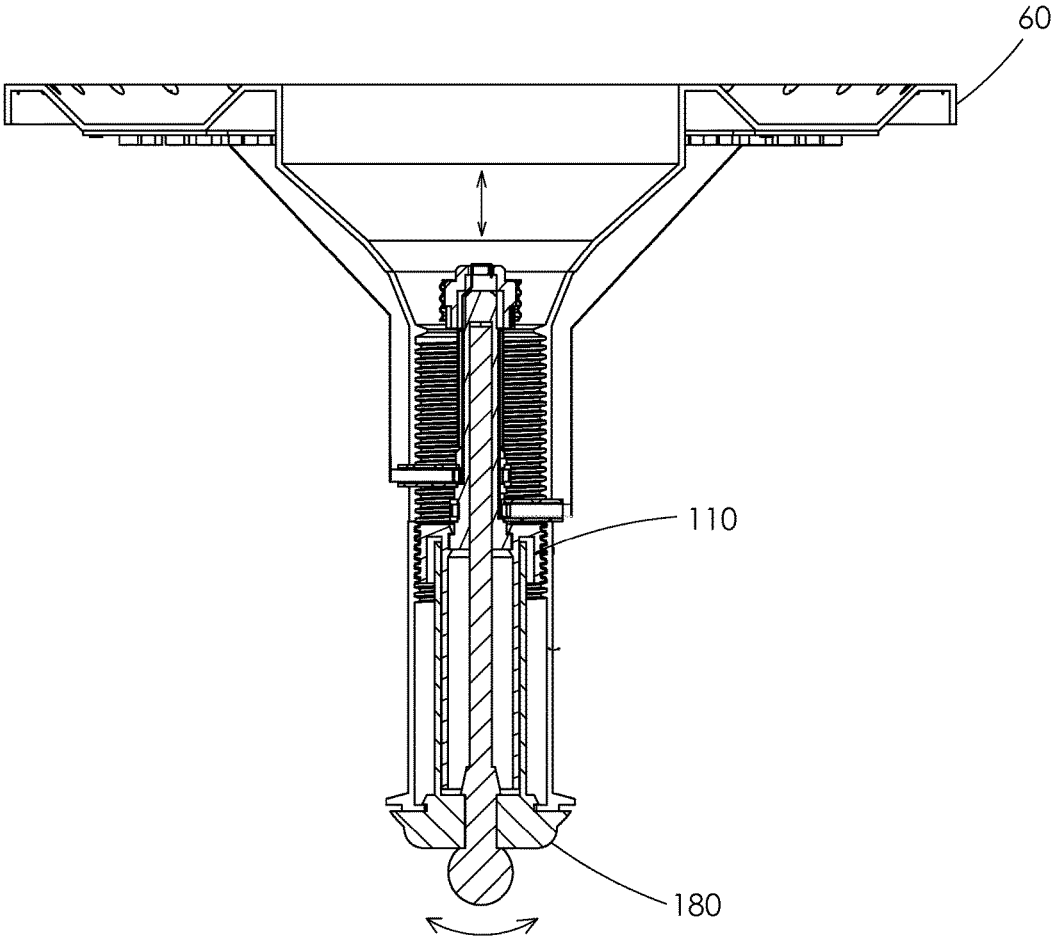
FIG. 7 is a cross-sectional view taken along line 7-7 in FIG. 6.
Figure 7A:
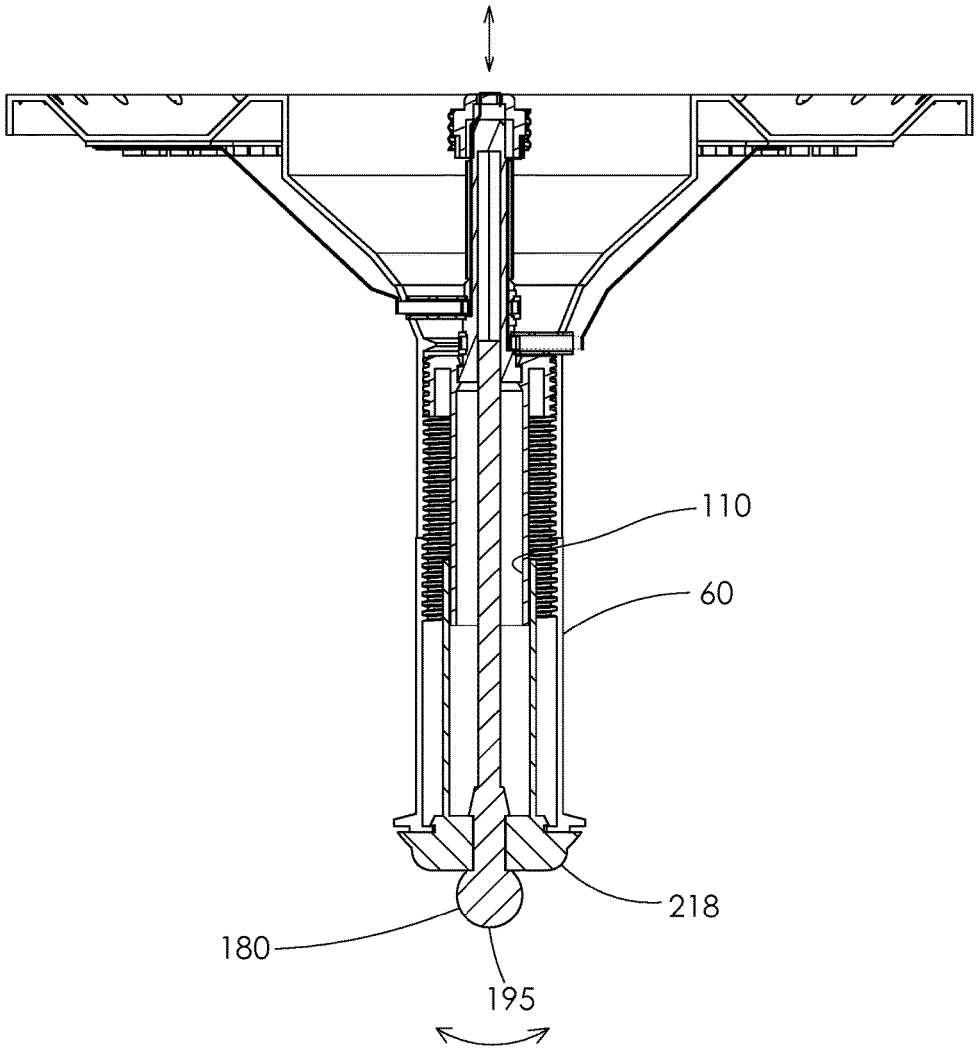
FIG. 7A is similar to FIG. 7, but shows the riser in an alternative position relative to the casing.

The lamp assembly can be selectably raised so that end 62 of the casing flushly engages the ceiling 10 of the fixed structure 5 after the assembly 50 is secured to the socket 20. This is accomplished by engaging the grip 218 of the second piece and rotating it. Rotation of grip 218 causes the first piece 120 of the riser 110 to rotate. Rotation of the first piece 120 of the riser causes the casing 60 to move vertically relative to the riser 110 due to interaction of the threads 124 and 92. FIG. 7 shows the riser in a first position relative to the casing. FIG. 7A shows the riser in a second position relative to the casing.

It is appreciated that the casing is preferably fully extended when the user to is securing the assembly to the socket 20. In this regard, there will be proper clearance between the assembly and the ceiling so that the third piece 160 can be fully connected to the socket 20. Then, after proper connection is made, the casing and hence the cover can be vertically raised to be flush with the ceiling.

The inward lip 94 of the central bore 90 of the casing is received within the recess 215 between the flange 216 and lip 217 of the control arm.

The cover 240 is held in place in two places. First, the cover 240 is held laterally by the outer ring 70 of the base section of the casing 60. Second, the cover 240 is held between the outer flange 93 of the casing 60 and the flange 216 of the control arm.

The collars 270 and 280 extend outward through slots 91 in the casing 60. In this regard, the slots allow for the collars to extend into or through the slots in a wide range of vertical adjustment between the riser and casing before the collars engage either end of the respective slots which act as limits to the vertical amount of travel or adjustment permitted by the assembly 50.

Figure 22:
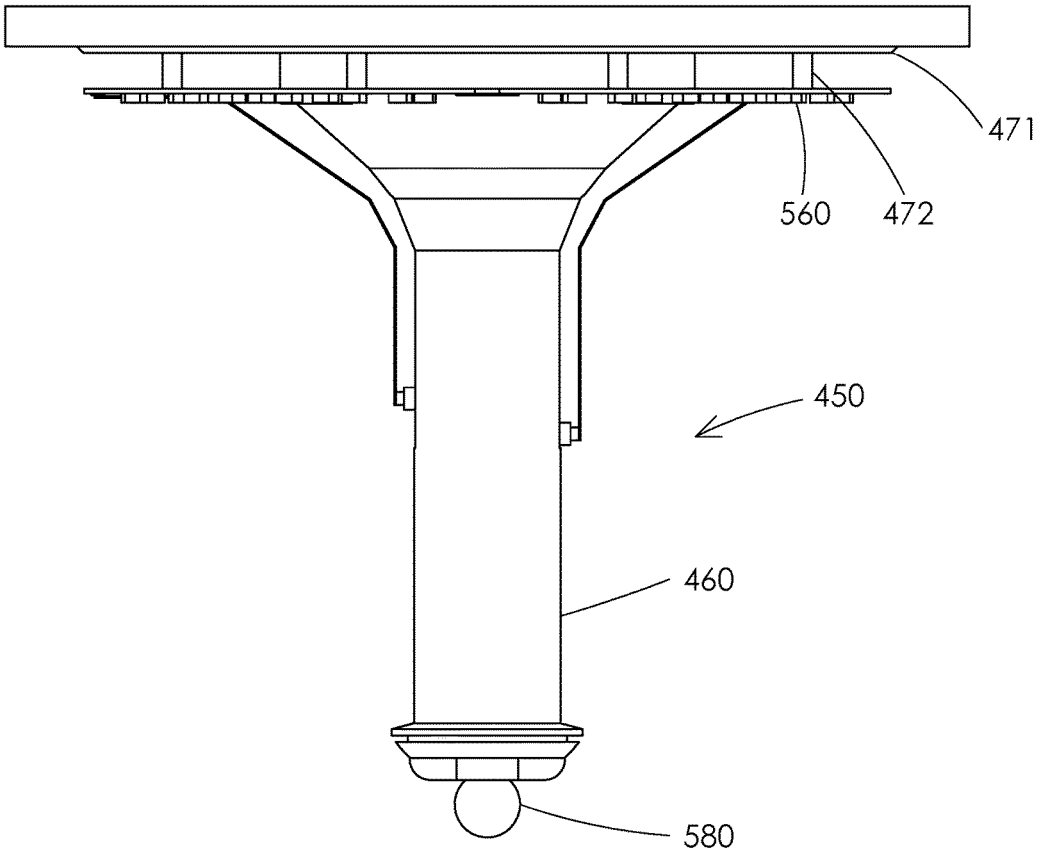
FIG. 22 is similar to FIG. 6, but shows an alternative embodiment for heat dissipation.

Turning now to FIG. 22, it is seen that an alternative embodiment for heat dissipation of the electronics 560 is provided. The assembly 450 has a casing 460 and a control arm 480. The casing has a raised section 471 with several fingers 472 or detents depending there from. The fingers 472 support boards a distance from the raised section upon which the LEDs are mounted. The spacing of the boards is spaced to allow the heat to dissipate.

Thus it is apparent that there has been provided, in accordance with the invention, a lamp assembly that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A lamp assembly connectable to a socket, said lamp assembly comprising:
- a casing with a bore having internal bore threads;
- a riser, said riser having:
  - a riser first piece with first piece external threads that threadably engage said internal bore threads;
  - a riser second piece; and
  - a riser third piece with a threaded connector that is selectably threadably connected to the socket; and
- a control arm,
- wherein said riser is movable relative to said casing upon rotation of said riser relative to said casing.

2. The lamp assembly of claim 1 wherein said riser second piece is rotatable relative to said riser first piece.

3. The lamp assembly of claim 1 wherein said control arm comprises:

a control arm first piece with a control arm first piece shaft engaging said riser second piece; and a control arm second piece.

4. The lamp assembly of claim 3 wherein rotation of said control arm first piece causes said riser second piece to rotate.

5. The lamp assembly of claim 3 wherein said control arm second piece is rotatably fixed with respect to said riser first piece such that rotation of said control arm second piece causes said casing to selectively raise or lower relative to said riser.

6. The lamp assembly of claim 5 wherein said riser third piece is fitted onto said riser second piece, and rotation of said control arm first piece causes said riser third piece to selectably connect or disconnect to the socket in a rotatable manner, and connection and disconnection to the socket is independent of raising and lowering of said casing.

7. The lamp assembly of claim 3 wherein:

said lamp assembly has a cover, said cover being supported by said casing;

said control arm first piece and said control arm second piece are independently engageable from an exterior of said lamp assembly.

8. The lamp assembly of claim 1 wherein said casing has vertical slots for clearance of electrical wires and said riser has a sheath to protect said electrical wires.

9. The lamp assembly of claim 1 wherein said casing has a tapered section, said tapered section providing clearance allowing said lamp assembly to cover the socket.

10. The lamp assembly of claim 1 wherein:

said lamp assembly further comprises at least one LED light; and said casing has at least one hole allowing an amount of air to pass there through.

11. A lamp assembly for removable insertion into a socket of a fixed structure, said lamp assembly comprising:

a structure, said structure comprising:

a casing with internal casing threads;

a riser, said riser having:

a riser first piece with first piece external threads that threadably engage said internal casing threads;

a riser second piece that is rotatable relative to said riser first piece; and a riser third piece with a threaded connector that is removably received within the socket; and a control arm; and a cover supported between said casing and said control arm, wherein said cover is vertically adjustable relative to the fixed structure as said riser moves relative to said casing.

12. The lamp assembly of claim 11 wherein said lamp assembly further comprises at least one LED light.

13. The lamp assembly of claim 11 wherein said control arm allows for two independent manipulations of said lamp assembly, namely:

twistable connection and disconnection to a fixture base by rotating a control arm second piece with a shaft; and vertical rising and lowering of said assembly without rotation of said casing relative to the socket by rotating a control arm first piece, which in turn causes said riser to move relative to said casing.

14. A lamp assembly comprising:

a first member allowing said lamp assembly to selectably connect to and disconnect from a fixture base; and a second member allowing said lamp assembly to selectably raise or lower relative to the fixture base, wherein:

said first member and said second member are parts of a control arm;

said lamp assembly further comprises a casing and a riser;

said casing has internal casing threads;

said riser has a riser first piece with external riser threads that threadably engage said internal casing threads to move said riser relative to said casing;

said riser has a riser second piece that is rotatable relative to said riser first piece, and also has a riser third piece fitted to said riser second piece, said riser third piece having an end that is threadably connectable to a socket of the fixture base as a result of manipulation of the first member; and said casing is selectably raised and lowered relative to the fixture base without rotation relative to the fixture base as a result of manipulation of the second member.

15. The lamp assembly of claim 14 wherein said lamp assembly further comprises at least one LED light.

* * * * *